US010360921B2

(12) United States Patent
Sung et al.

(10) Patent No.: US 10,360,921 B2
(45) Date of Patent: Jul. 23, 2019

(54) METHOD AND APPARATUS FOR DETERMINING CODING MODE

(71) Applicant: SAMSUNG ELECTRONICS CO., LTD., Suwon-si (KR)

(72) Inventors: Ho-sang Sung, Yongin-si (KR); Jie Zhan, Beijing (CN); Ki-hyun Choo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/822,392

(22) Filed: Nov. 27, 2017

(65) Prior Publication Data

US 2018/0075857 A1 Mar. 15, 2018

Related U.S. Application Data

(63) Continuation of application No. 15/629,375, filed on Jun. 21, 2017, now Pat. No. 9,847,090, which is a continuation of application No. 12/458,385, filed on Jul. 9, 2009, now abandoned.

(30) Foreign Application Priority Data

Jul. 9, 2008 (KR) ..... 10-2008-0066737

(51) Int. Cl.

| | |
|---|---|
| ***G10L 19/18*** | (2013.01) |
| ***G10L 19/20*** | (2013.01) |
| ***G10L 19/22*** | (2013.01) |
| ***G10L 25/78*** | (2013.01) |
| ***G10L 25/81*** | (2013.01) |
| ***G10L 25/90*** | (2013.01) |

(52) U.S. Cl.

CPC ..... *G10L 19/20* (2013.01); *G10L 19/18* (2013.01); *G10L 19/22* (2013.01); *G10L 25/78* (2013.01); *G10L 25/81* (2013.01); *G10L 25/90* (2013.01)

(58) Field of Classification Search

CPC ..... G10L 19/18; G10L 19/20; G10L 19/22; G10L 19/24

See application file for complete search history.

(56) References Cited

U.S. PATENT DOCUMENTS

| | | |
|---|---|---|
| 4,375,083 A | 2/1983 | Maxemchuk |
| 4,388,495 A | 6/1983 | Hitchcock |
| 4,441,200 A | 4/1984 | Fette et al. |

(Continued)

FOREIGN PATENT DOCUMENTS

| | | |
|---|---|---|
| CN | 1462426 | 12/2003 |
| EP | 1738355 | 9/2010 |

(Continued)

OTHER PUBLICATIONS

Japanese Office Action dated Nov. 4, 2015 in corresponding Japanese Patent Application No. 2014-205254.

(Continued)

*Primary Examiner* — Eric Yen

(74) *Attorney, Agent, or Firm* — Staas & Halsey LLP

(57) ABSTRACT

Provided is a method and apparatus for determining a signal coding mode. The signal coding mode may be determined or changed according to whether a current frame corresponds to a silence period and by using a history of speech or music presence possibilities.

4 Claims, 8 Drawing Sheets

(56) References Cited

U.S. PATENT DOCUMENTS

| | | | | |
|---|---|---|---|---|
| 4,561,102 | A | 12/1985 | Prezas | |
| 4,653,098 | A | 3/1987 | Nakata et al. | |
| 4,771,465 | A | 9/1988 | Bronson et al. | |
| 4,805,219 | A | 2/1989 | Baker et al. | |
| 4,959,865 | A | 9/1990 | Stettiner et al. | |
| 5,007,093 | A | 4/1991 | Thomson | |
| 5,224,167 | A | 6/1993 | Taniguchi et al. | |
| 5,455,888 | A | 10/1995 | Iyengar et al. | |
| 5,546,395 | A | 8/1996 | Sharma et al. | |
| 5,596,676 | A | 1/1997 | Swaminathan et al. | |
| 5,596,678 | A | 1/1997 | Wigren et al. | |
| 5,611,019 | A | 3/1997 | Nakatoh et al. | |
| 5,668,927 | A | 9/1997 | Chan et al. | |
| 5,706,394 | A | 1/1998 | Wynn | |
| 5,774,837 | A | 6/1998 | Yeldener | |
| 5,774,849 | A | 6/1998 | Benyassine et al. | |
| 5,778,335 | A * | 7/1998 | Ubale | G10H 1/125 704/219 |
| 5,787,389 | A | 7/1998 | Taumi | |
| 5,890,109 | A | 3/1999 | Walker et al. | |
| 5,937,374 | A | 8/1999 | Bartkowiak et al. | |
| 5,974,374 | A | 10/1999 | Wake | |
| 6,012,024 | A | 1/2000 | Hofmann | |
| 6,134,518 | A | 10/2000 | Cohen et al. | |
| 6,327,562 | B1 | 12/2001 | Proust | |
| 6,337,947 | B1 | 1/2002 | Porter et al. | |
| 6,360,199 | B1 | 3/2002 | Yokoyama | |
| 6,418,408 | B1 | 7/2002 | Udaya Bhaskar et al. | |
| 6,556,966 | B1 | 4/2003 | Gao | |
| 6,570,991 | B1 | 5/2003 | Scheirer | |
| 6,614,370 | B2 | 9/2003 | Gottesman | |
| 6,631,352 | B1 | 10/2003 | Fujita et al. | |
| 6,633,841 | B1 * | 10/2003 | Thyssen | G10L 19/18 375/242 |
| 6,647,366 | B2 * | 11/2003 | Wang | G10L 19/22 704/201 |
| 6,782,467 | B1 | 8/2004 | Rezeanu | |
| 6,785,645 | B2 | 8/2004 | Khalil et al. | |
| 6,836,514 | B2 | 12/2004 | Gandhi et al. | |
| 6,940,967 | B2 | 9/2005 | Makinen et al. | |
| 6,959,276 | B2 | 10/2005 | Droppo et al. | |
| 7,158,572 | B2 | 1/2007 | Dunne et al. | |
| 7,171,354 | B1 | 1/2007 | Yoshida et al. | |
| 7,206,414 | B2 | 4/2007 | Schulz | |
| 7,356,464 | B2 | 4/2008 | Stella et al. | |
| 7,412,376 | B2 | 8/2008 | Florencio et al. | |
| 7,496,505 | B2 | 2/2009 | Manjunath et al. | |
| 7,500,018 | B2 | 3/2009 | Hakansson et al. | |
| 7,747,430 | B2 | 6/2010 | Makinen | |
| 8,209,187 | B2 | 6/2012 | Kurittu | |
| 8,244,525 | B2 | 8/2012 | Makinen | |
| 8,315,865 | B2 | 11/2012 | Kuris | |
| 2002/0111798 | A1 | 8/2002 | Huang | |
| 2002/0173951 | A1 | 11/2002 | Ehara | |
| 2003/0101050 | A1 * | 5/2003 | Khalil | G10L 19/22 704/216 |
| 2003/0105624 | A1 | 6/2003 | Yokohama | |
| 2004/0125961 | A1 | 7/2004 | Alessio et al. | |
| 2005/0055203 | A1 | 3/2005 | Makinen et al. | |
| 2005/0143984 | A1 | 6/2005 | Makinen et al. | |
| 2005/0240399 | A1 * | 10/2005 | Makinen | G10L 19/22 704/223 |
| 2005/0261900 | A1 | 11/2005 | Ojala et al. | |
| 2007/0223577 | A1 | 9/2007 | Ehara | |
| 2008/0077410 | A1 | 3/2008 | Ojala | |
| 2008/0140392 | A1 | 6/2008 | Kim | |
| 2008/0147414 | A1 * | 6/2008 | Son | G10L 19/20 704/500 |
| 2008/0162121 | A1 | 7/2008 | Son et al. | |
| 2008/0195383 | A1 | 8/2008 | Shlomot | |
| 2009/0094024 | A1 | 4/2009 | Yamanashi et al. | |
| 2009/0187409 | A1 | 7/2009 | Krishnan et al. | |
| 2009/0319261 | A1 | 12/2009 | Gupta et al. | |
| 2010/0017202 | A1 | 1/2010 | Sung et al. | |
| 2010/0145688 | A1 | 6/2010 | Sung | |
| 2010/0312567 | A1 | 12/2010 | Oh et al. | |
| 2011/0161087 | A1 | 6/2011 | Ashley | |
| 2016/0293175 | A1 | 10/2016 | Atti | |

FOREIGN PATENT DOCUMENTS

| | | |
|---|---|---|
| JP | 61-184599 | 8/1986 |
| JP | 11-175098 | 7/1999 |
| JP | 2002-99299 | 4/2002 |
| JP | 2003-509707 | 3/2003 |
| JP | 2007-523388 | 8/2007 |
| JP | 2007-534020 | 11/2007 |
| KR | 10-2010-0006492 | 1/2010 |
| WO | 2008/045846 | 4/2008 |
| WO | WO 2008/045846 | 4/2008 |
| WO | 2008/072913 | 6/2008 |

OTHER PUBLICATIONS

Japanese Final Rejection dated Jun. 3, 2014 in corresponding Japanese Patent Application No. JP 2011-517354.

Korean Office Action dated Jul. 28, 2014 in corresponding Korean Application No. 10-2008-0066737.

Korean Notice of Allowance dated Jun. 5, 2015 in corresponding Korean Patent Application No. 10-2008-0066737.

Japanese Final Rejection dated Jul. 30, 2013 in related Japanese Application No. 2011-517354.

Chinese Office Action dated Mar. 11, 2013 in Chinese Application No. 200980135140.7 (4 pages) English Translation 8 pages.

Japanese Office Action dated Oct. 30, 2012 in Japanese Patent Application No. 2011-517354.

Chinese Office Action dated Sep. 13, 2012 in corresponding Chinese Patent Application No. 200980135140.7.

International Search Report issued by the Korean Intellectual Property Office dated Jan. 20, 2010 in relation to PCT/KR2009/0033777.

Chinese Office Action dated Apr. 13, 2012 in corresponding Chinese Application No. 200980135140.7.

European Examination report issued in European Patent Application No. 09794660.2-1224 dated Jun. 21, 2012.

European Extended Search Report dated Oct. 21, 2011 corresponds to European Patent Application No. 09794660.2-1224.

Non-Final Office Action dated Apr. 15, 2013 in parent U.S. Appl. No. 12/458,385 (27 pages).

Restriction Office Action dated Nov. 26, 2012 in parent U.S. Appl. No. 12/458,385 (26 pages).

Advisory Action dated Jan. 3, 2014 in parent U.S. Appl. No. 12/458,385 (9 pages).

Final Office Action dated Oct. 16, 2013 in parent U.S. Appl. No. 12/458,385 (28 pages).

Non-Final Office Action dated Mar. 12, 2014 in parent U.S. Appl. No. 12/458,385 (24 pages).

Final Office Action dated Aug. 13, 2014 in parent U.S. Appl. No. 12/458,385 (29 pages).

Advisory Action dated Oct. 22, 2014 in parent U.S. Appl. No. 12/458,385 (4 pages).

Non-Final Office Action dated Mar. 2, 2015 in parent U.S. Appl. No. 12/458,385 (20 pages).

Final Office Action dated Sep. 11, 2015 in parent U.S. Appl. No. 12/458,385 (44 pages).

Non-Final Office Action dated Apr. 5, 2016 in parent U.S. Appl. No. 12/458,385 (16 pages).

Final Office Action dated Dec. 21, 2016 in parent U.S. Appl. No. 12/458,385 (43 pages).

Japanese Office Action dated Mar. 28, 2017 in related Japanese Patent Application No. 2014-205254 (2 pages) (3 pages English Translation).

U.S. Notice of Allowance dated Aug. 7, 2017 in U.S. Appl. No. 15/629,375.

U.S Appl. No. 12/458,385, filed Jul. 9, 2009, Ho-sang Sung, et al., Samsung Electronics Co., Ltd.

U.S. Appl. No. 15/629,375, filed Jun. 21, 2017, Ho-sang Sung, et al., Samsung Electronics Co., Ltd.

(56) References Cited

OTHER PUBLICATIONS

European Search Report dated Jun. 27, 2018 in European Patent Application No. 18161810.9.
Ludovic Tancerel, et al., "Combined Speech and Audio Coding by Discrimination", Proceedings of the IEEE Workshop on Speech Coding, Sep. 2000, pp. 154-156.
Japanese Office Action dated Oct. 9, 2018 in Japanese Patent Application No. 2017-152050.

* cited by examiner

METHOD AND APPARATUS FOR DETERMINING CODING MODE

CROSS-REFERENCE TO RELATED APPLICATIONS

This application is a continuation application U.S. patent application Ser. No. 15/629,375, filed on Jun. 21, 2017, which is a continuation application of U.S. patent application Ser. No. 12/458,385, filed on Jul. 9, 2009, which claims the benefit of Korean Patent Application No. 10-2008-0066737, filed on Jul. 9, 2008, in the Korean Intellectual Property Office, the disclosures of which are incorporated herein in their entirety by reference.

BACKGROUND

1. Field

One or more embodiments relate to a method and apparatus for encoding or decoding an audio signal with music and speech characteristics, and more particularly, to a method and apparatus for efficiently encoding and decoding such an audio signal by using a small number of bits.

2. Description of the Related Art

When coding audio, one of a plurality of various coding modes may be selected to code an input signal by analyzing the characteristic of the input signal. For example, a frequency-domain coding mode such as an advanced audio codec (AAC) method or a time-domain coding mode such as a code excited linear prediction (CELP) method may be selected to code the input signal. Conventionally, if the characteristic of the input signal is determined to more closely represent characteristics of music, the frequency-domain coding mode is selected to code the input signal. If the characteristic of the input signal is determined to more closely represent characteristics of speech, the time-domain coding mode is selected to code the input signal.

Here, in such an operation, when a coding mode of an input signal is selected, the characteristics of signals in previous frames may be stored and the coding mode of a current frame may be determined based on the stored characteristics of the previous frames as well as characteristic of the current frame. However, in such an approach, both the number of times that a signal coding mode changes, and any corresponding delay caused by such changes, should be reduced.

SUMMARY

One or more embodiments include a method and apparatus for determining an efficient signal coding mode from among a plurality of coding modes.

According to one or more embodiments, there is provided a coding mode determination method with a determined coding mode of a signal in a current frame being based on stored information or parameters regarding signals in one or more previous frames, the method including determining whether the signal in the current frame corresponds to a silence period, and resetting the stored information or parameters when the signal in the current frame corresponds to the silence period.

According to one or more embodiments, there is provided a coding mode determination method including determining a coding mode of a signal in a current frame, calculating a speech or music presence possibility of the signal in the current frame, determining whether to change the determined coding mode based on a history of speech or music presence possibilities of signals in one or more previous frames and the calculated speech or music presence possibility, and changing the determined coding mode when the determining of whether to change the determined coding mode indicates that the coding mode should change.

According to one or more embodiments, there is provided a coding mode determination apparatus including a storage unit storing information or parameters regarding signals in one or more previous frames, a coding mode determination unit determining a coding mode of a signal in a current frame by using the stored information or parameters, a silence period determination unit determining whether the signal in the current frame corresponds to a silence period, and a reset unit resetting the stored information or parameters if the signal in the current frame corresponds to the silence period.

According to one or more embodiments, there is provided a coding mode determination apparatus including a coding mode determination unit determining a coding mode of a signal in a current frame, a signal analysis unit calculating a speech or music presence possibility of the signal in the current frame, a change determination unit determining whether to change the determined coding mode based on a history of speech or music presence possibilities of signals in one or more previous frames and the calculated speech or music presence possibility, and a mode change unit changing the determined coding mode when the change determination unit determines to change the determined coding mode.

According to one or more embodiments, there is provided a computer readable recording medium having recorded thereon computer readable code to control at least one processing device to implement a coding mode determination method with a determined coding mode of a signal in a current frame being based on stored information or parameters regarding signals in one or more previous frames, the method including determining whether the signal in the current frame corresponds to a silence period, and resetting the stored information or parameters when the signal in the current frame corresponds to the silence period.

According to one or more embodiments, there is provided a computer readable recording medium having recorded thereon computer readable code to control at least one processing device to implement a coding mode determination method, the method including determining a coding mode of a signal in a current frame, calculating a speech or music presence possibility of the signal in the current frame, determining whether to change the determined coding mode based on a history of speech or music presence possibilities of signals in one or more previous frames and the calculated speech or music presence possibility, and changing the determined coding mode when the determining of whether to change the determined coding mode indicates that the coding mode should change.

Additional aspects will be set forth in part in the description which follows and, in part, will be apparent from the description, or may be learned by practice of the presented embodiments.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION OF EMBODIMENTS

Figure 1:
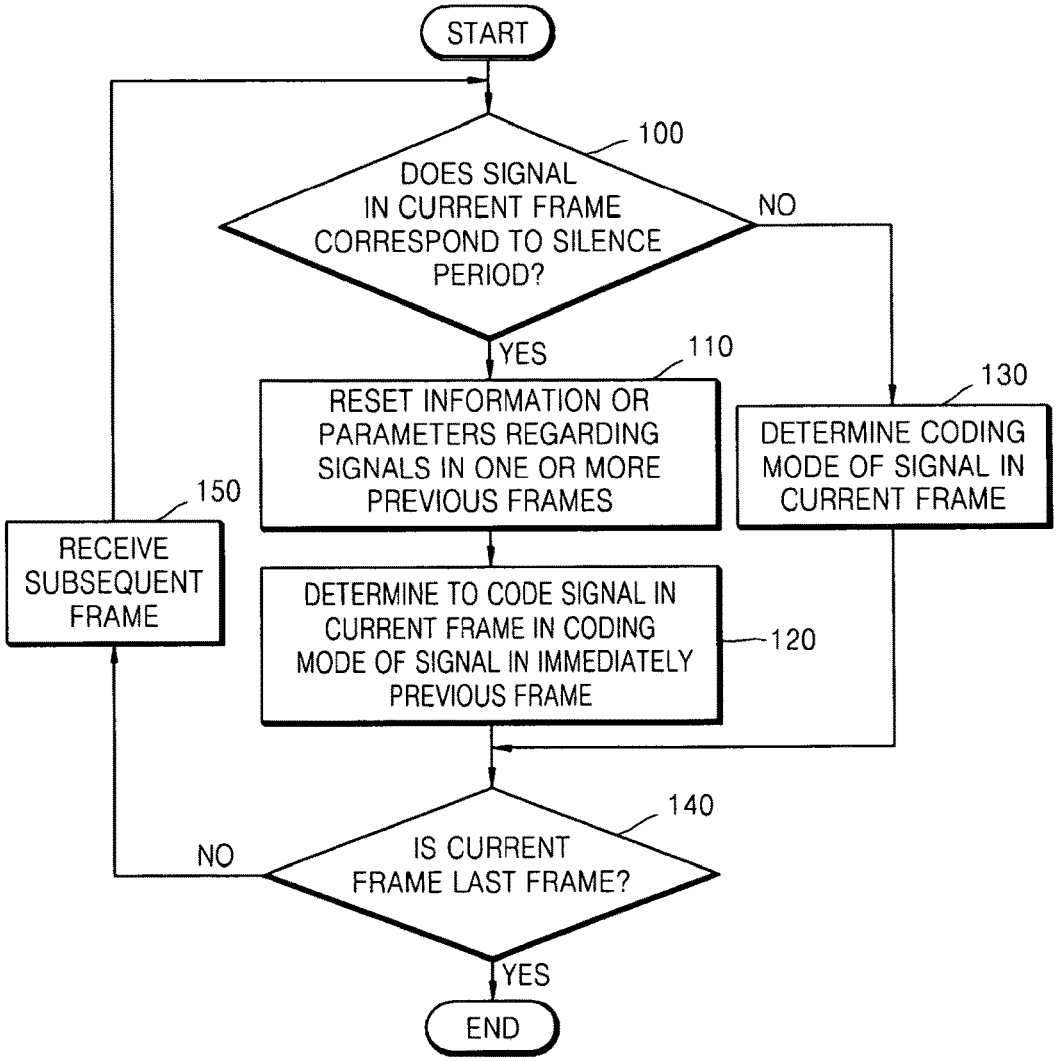
FIG. 1 illustrates a coding mode determination method, according to one or more embodiments.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

FIG. 1 illustrates a coding mode determination method, according to one or more embodiments.

Referring to FIG. 1, initially, a determination is made as to whether a signal in a current frame corresponds to a silence period (operation 100). The determination in operation 100 may be performed based on the energy or the characteristic of the signal in the current frame. As only an example, if the energy is less than a threshold value, it may be determined that the signal in the current frame corresponds to the silence period, noting that additional and/or alternative silence detecting techniques are equally available.

If the determination of operation 100 indicates that the signal in the current frame corresponds to a silence period, there may be a reset of information or parameters regarding signals in one or more previous frames. The information or parameters may have been stored for subsequent use in determining an appropriate coding mode of the signal, such as in the current frame, from among a plurality of signal coding modes (operation 110).

The information or the parameters regarding the signals in the previous frames may be information or parameters regarding long-term signal features, for example. In operation 110, from among the long-term features, a mean value regarding short-term features of signals in a pre-set number of previous frames, or a history value of speech or music presence possibilities of a signal in a predetermined frame may be reset, for example.

Here, the long-term feature refers to information obtained by analyzing transitions of short-term features of signals in one or more previous frames. For example, long-term features may include a mean value regarding short-term features of signals in a pre-set number of previous frames, a speech or music presence possibility of a signal in a predetermined frame, and a history value of speech or music presence possibilities. A short-term feature refers to a peculiar characteristic of each frame and may include at least one selected from the group including information or parameters such as a linear prediction-long term prediction (LP-LTP) gain, a spectrum tilt, a zero crossing rate, and a spectrum auto-correlation, for example.

After operation 110 is performed, a determination made as to whether to code the signal in the current frame in a same coding mode as a signal in an immediately previous frame (operation 120).

If the determination of operation 100 indicates that the signal in the current frame does not correspond to a silence period, an analysis of the current frame is performed to analyze a characteristic of the signal in the current frame, e.g., so as to extract information or a parameter regarding the signal in the current frame. A determination is then made as to what coding mode, from among a plurality of signal coding modes, should be used for the signal in the current frame based on the information or the parameters regarding the signals in the previous frames and the information or the parameter regarding the signal in the current frame (operation 130). Examples of the information or the parameter regarding the signal in the current frame, which is extracted in operation 130, include the above-described short-term and long-term features.

Here, examples of such signal coding modes include a time-domain coding mode such as a code excited linear prediction (CELP) method and a frequency-domain coding mode such as a transform coded excitation (TCX) method or an advanced audio codec (AAC) method. The examples of the signal coding modes may also include a speech coding mode and a music coding mode. Here, additional and/or alternative coding modes may be available, and embodiments are not limited to such indicated coding modes.

After operation 120 or operation 130 is performed, a determination is made as to whether the current frame is a last frame (operation 140).

If the determination of operation 140 indicates that the current frame is not the last frame, a subsequent frame may be received (operation 150) and operations 100 through 150 may be repeatedly performed on the subsequent frame(s).

Figure 2:
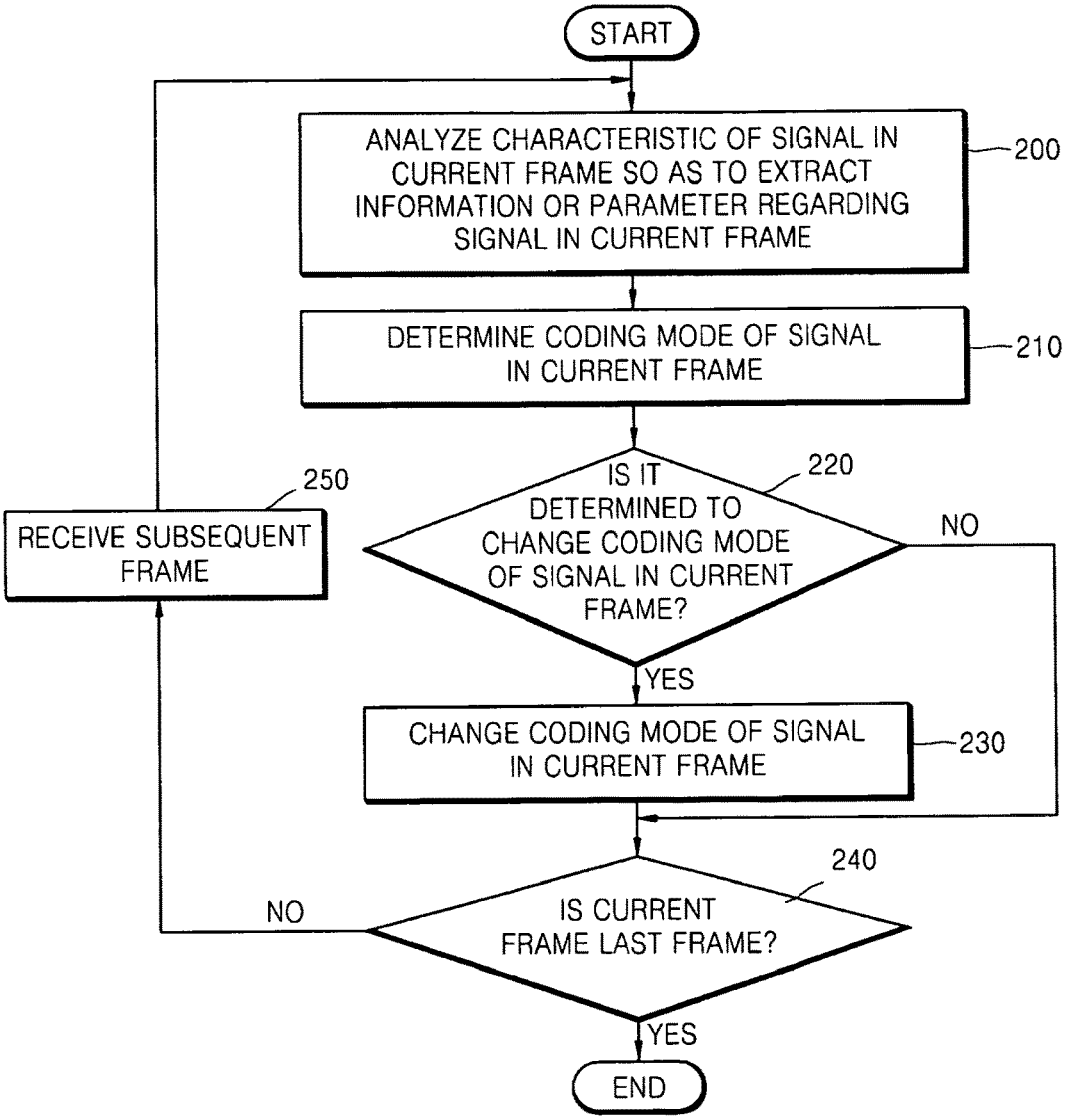
FIG. 2 illustrates a coding mode determination method, according to one or more embodiments.

FIG. 2 illustrates a coding mode determination method, according to one or more embodiments.

Referring to FIG. 2, initially, the characteristic of a signal in a current frame is analyzed so as to extract information or a parameter regarding the signal in the current frame (operation 200). Examples of the information or the parameter extracted in operation 200 include short-term and long-term features, for example. A short-term feature refers to a peculiar characteristic of each frame and may include at least one of information or parameters such as an LP-LTP gain, a spectrum tilt, a zero crossing rate, and a spectrum auto-correlation, for example. The process may further include a selection of one or more of these information or parameters. A long-term feature refers to information obtained by analyzing transitions of short-term features of signals in one or more previous frames. For example, the long-term feature may include a mean value regarding short-term features of signals in a pre-set number of previous frames, a speech or music presence possibility of a signal in a predetermined frame, and a history value of speech or music presence possibilities, for example.

From among the long-term features, a speech presence possibility (SPP) may be calculated by using the below Equation 1, for example. Hereinafter, the SPP will be representatively described. However, embodiments of the present invention are not limited to the SPP.

$$SPP=SNR_W \cdot SNR_SP+TILT_W \cdot TILT_SP+ZC_W \cdot ZC_SP \quad \text{Equation 1:}$$

Here, SNR_W represents a weight on SNR_SP, TILT_W represents a weight on TILT_SP, ZC_W represents a weight on ZC_SP, SNR_SP represents a long-term feature regarding an LP-LTP gain and may be calculated by using Equation 2, TILT_SP represents a long-term feature regarding a spectrum tilt and may be calculated by using the below Equation 3, for example, and ZC_SP represents a long-term feature regarding a zero crossing rate and may be calculated by using the below Equation 4, again as only an example.

$$\text{if } (SNR_VAR>SNR_THR) \quad \text{Equation 2:}$$

$$SNR_SP=a*SNR_SP+(1-a)*SNR_VAR$$

$$\text{else}$$

$$SNR_SP-=D_1$$

Here, SNR_VAR represents a difference value or an absolute value of a difference value between an LP-LTP gain of a current frame and a mean value of LT-LTP gains of a predetermined number of frames prior to the current frame, SNR_THR represents a threshold value, SNR_SP has an initial value of 0, a is a real number between 0 and 1 and represents a weight on SNR_SP and SNR_VAR, $D_1$ is $\beta_1$×(SNR_THR/an LT-LTP gain), and $\beta_1$ is a constant representing a degree of decrease.

$$\text{if } (TILT_VAR>TILT_THR)$$

$$TILT_SP=a_2*TILT_SP+(1-a_2)*TILT_VAR$$

$$\text{else}$$

$$TILT_SP-=D_2 \quad \text{Equation 3:}$$

Here, TILT_VAR represents a difference value or an absolute value of a difference value between a spectrum tilt of a current frame and a mean value of spectrum tilts of a predetermined number of frames prior to the current frame, TILT_THR represents a threshold value, TILT_SP has an initial value of 0, $a_2$ is a real number between 0 and 1 and represents a weight on TILT_SP and TILT_VAR, $D_2$ is $\beta_2$×(TILT_THR/a spectrum tilt), and $\beta_2$ is a constant representing a degree of decrease.

$$\text{if } (ZC_VAR>ZC_THR)$$

$$ZC_SP=a_3*AC_SP+(1-a_3)*ZC_VAR$$

$$\text{else}$$

$$ZC_SP-=D_3 \quad \text{Equation 4:}$$

Here, ZC_VAR represents a difference value or an absolute value of a difference value between a zero crossing rate of a current frame and a mean value of zero crossing rates of a predetermined number of frames prior to the current frame, ZC_THR represents a threshold value, ZC_SP has an initial value of 0, $a_3$ is a real number between 0 and 1 and represents a weight on ZC_SP and ZC_VAR, $D_3$ is $\beta_3$×(ZC_THR/a zero-crossing rate), and $\beta_3$ is a constant representing a degree of decrease.

In addition, the history value of the speech or music presence possibilities refers to a value obtained by applying weights to speech or music presence possibilities of signals in a predetermined number of frames and accumulating the speech or music presence possibilities. A method of calculating a history value of SPPs will be representatively described later with reference to FIG. 3, as only an example.

A coding mode of the signal in the current frame may be selected from among a plurality of available signal coding modes by using the information or the parameter regarding the signal in the current frame, which is extracted in operation 200 (operation 210). Examples of the signal coding modes include a time-domain coding mode such as a CELP method and a frequency-domain coding mode such as a TCX method or an AAC method. The examples of the signal coding modes may also include a speech coding mode and a music coding mode. Here, additional and/or alternative coding modes may be available, and embodiments are not limited to such indicated coding modes.

After performing operation 210, a determination is made as to whether to change the coding mode selected in operation 210, by using a coding mode of a signal in one or more previous frames, and/or speech or music presence possibilities of signals in a predetermined number of previous frames and the signal in the current frame (operation 220). The speech or music presence possibilities of the signals in the previous frames and the signal in the current frame may be represented by the above-described history value of the speech or music presence possibilities, for example.

If the determination of operation 220 indicates to change the coding mode selected in operation 210, the coding mode determined in operation 210 is changed (operation 230).

If the determination of operation 220 indicates to not change the coding mode selected in operation 210, or after performing operation 230, a determination is then made as to whether the current frame is a last frame (operation 240).

If the determination of operation 240 indicates that the current frame is not the last frame, a subsequent frame may be received (operation 250) and operations 200 through 240 may be repeatedly performed on the subsequent frame(s). The coding mode used for the current frame may be stored along with corresponding information or parameters for determining the coding mode of such subsequent frames.

Figure 3:
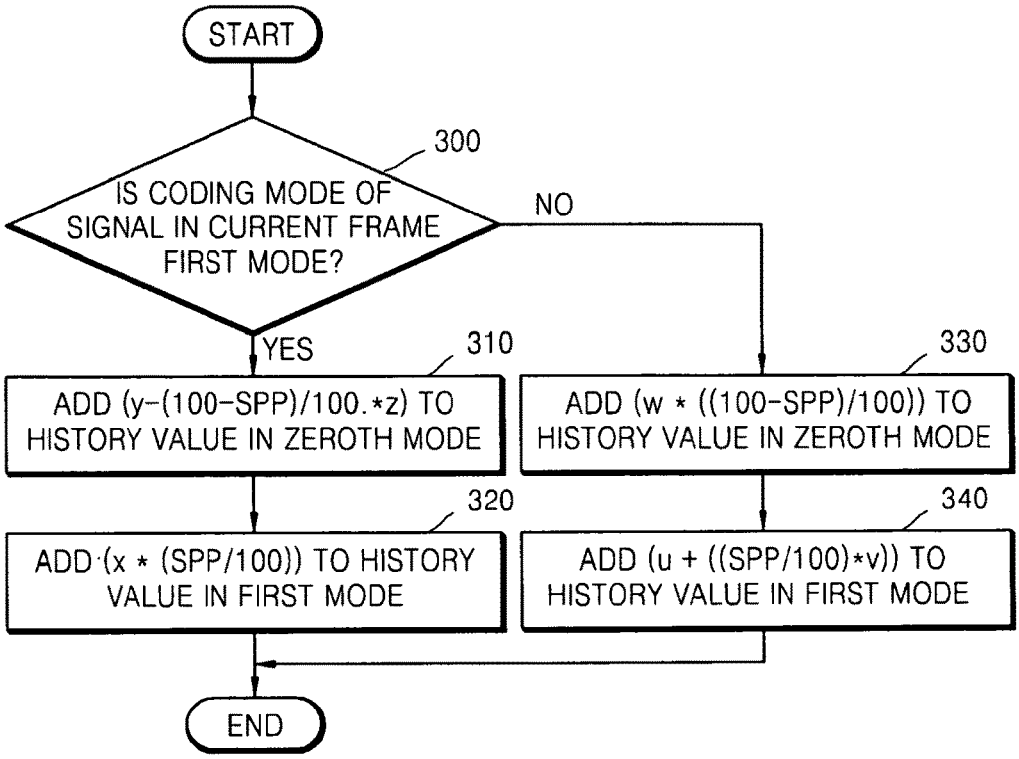
FIG. 3 illustrates a method of calculating a history value of speech presence possibilities (SPPs), according to one or more embodiments.

FIG. 3 illustrates a method of calculating a history value of SPPs, according to one or more embodiments.

Referring to FIG. 3, a determination is made as to whether a coding mode of a signal in a current frame, e.g., as determined in operation 210 in FIG. 2, is a zeroth mode or a first mode (operation 300). Here, the zeroth mode refers to a frequency-domain coding mode or a music coding mode, and the first mode refers to a time-domain coding mode or a speech coding mode.

If the determination of operation 300 indicates that the coding mode selected in operation 210 should be the first mode, a history value in the zeroth mode is calculated by using the below example Equation 5 (operation 310).

$$Mode0_Hysteresis+=(y-(100-SPP)/100.*z) \quad \text{Equation 5:}$$

Here, Mode0_Hysteresis represents a history value in the zeroth mode, and y and z represent pre-set values, for example.

After performing operation 310, a history value in the first mode may be calculated by using the below example Equation 6 (operation 320).

$$Mode1_Hysteresis+=(x**SPP/100)) \quad \text{Equation 6:}$$

Here, Mode1_Hysteresis represents a history value in the first mode, and x represents a pre-set value, for example.

Otherwise, if the determination of operation 300 indicates that the coding mode selected in operation 210 should be the zeroth mode, the history value in the zeroth mode may be calculated by using the below example Equation 7 (operation 330).

$$\text{Mode0_Hysteresis}+=(w*((100-\text{SPP})/100)) \quad \text{Equation 7:}$$

Here, Mode0_Hysteresis represents a history value in the zeroth mode, and w represents a pre-set value, for example.

After performing operation 330, the history value in the first mode may be calculated by using the below example Equation 8 (operation 340).

$$\text{Mode1_Hysteresis}+=(u+((\text{SPP}/100)*v)) \quad \text{Equation 8:}$$

Here, Mode1_Hysteresis represents a history value in the first mode, and u and v represent pre-set values, for example.

However, minimum and maximum values regarding a history value of speech or music presence possibilities may be previously set. For example, the minimum value of the history value may be set as 0 and the maximum value of the history value may be set as 1. If a variation range of the history value is reduced by reducing a range between the minimum and maximum values, the number of times that a signal coding mode is permitted to change may be increased and a delay caused when the signal coding mode is changed may be reduced. On the other hand, if a variation range of the history value is increased by increasing a range between the minimum and maximum values, the number of times that a signal coding mode is permitted to change may be reduced and a delay caused when the signal coding mode is changed may be increased. Thus, the minimum and maximum values of the history value may be previously controlled and set according to a coding environment or the characteristic of a signal.

Figure 4:
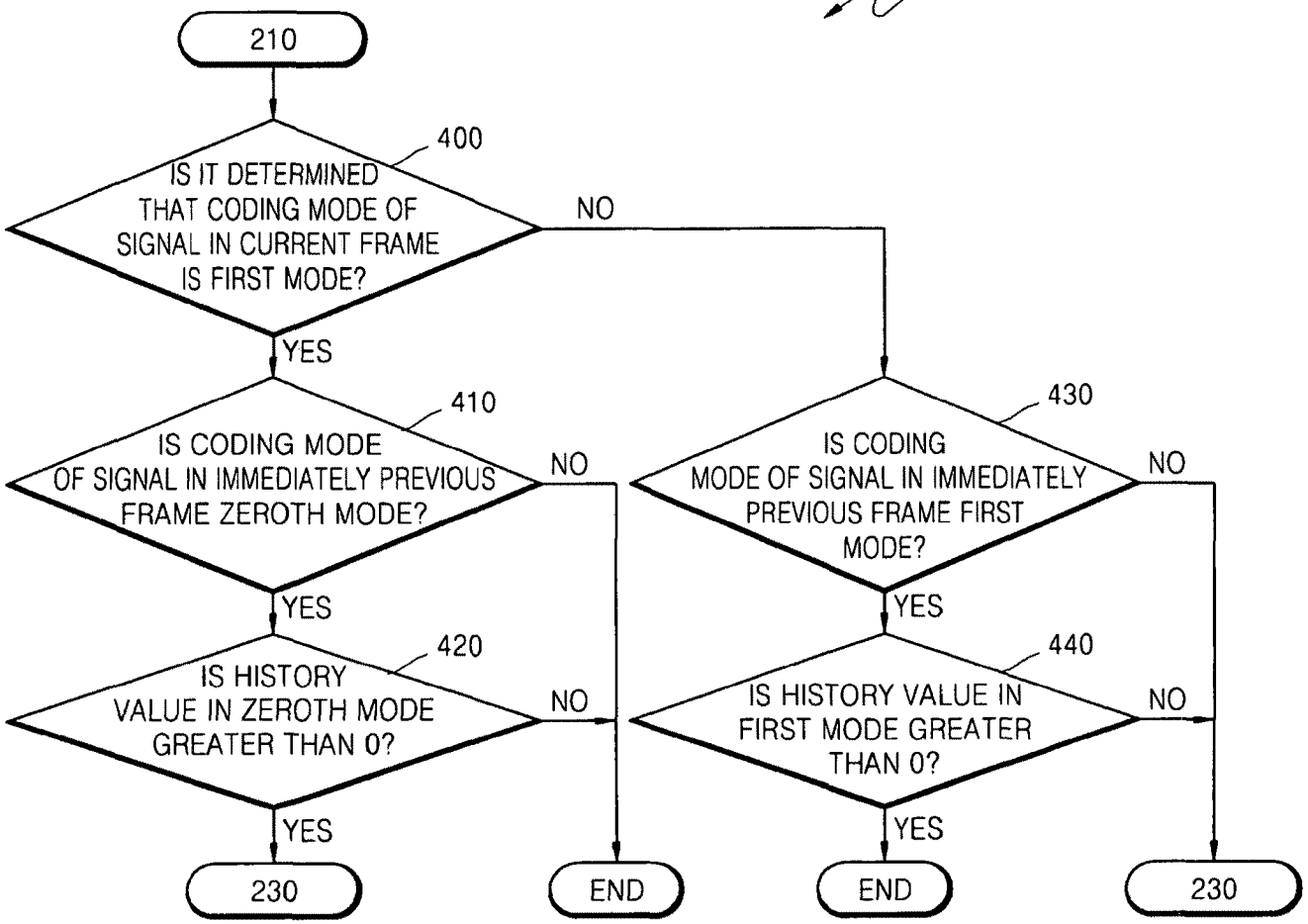
FIG. 4 illustrates a coding mode changing operation of a coding mode determination method, such as the coding mode determination method of FIG. 2, according to one or more embodiments.

FIG. 4 illustrates a coding mode changing operation of a coding mode determination method, such as the coding changing operation 220 in FIG. 2, according to one or more embodiments.

Referring to FIG. 4, initially, a determination is made as to whether a coding mode of a signal for a current frame, e.g., as selected in operation 210, is a zeroth mode or a first mode (operation 400). Here, the zeroth mode refers to a frequency-domain coding mode or a music coding mode, and the first mode refers to a time-domain coding mode or a speech coding mode.

If the determination of operation 400 indicates that the selected coding mode is the first mode, there may then be a determination as to whether a coding mode of a signal in an immediately previous frame, for example, is the zeroth mode or the first mode (operation 410).

If the determination of operation 410 indicates that the coding mode of the signal in the immediately previous frame is the zeroth mode, there may be a further determination as to whether a history value in the zeroth mode is greater than an example 0 (operation 420).

If the determination of operation 420 indicates that the history value in the zeroth mode is greater than the example 0, the coding mode of the signal for the current frame, e.g., as selected in operation 210, may be changed from the first mode to the zeroth mode (operation 230).

Otherwise, if the determination of operation 410 indicates that the coding mode of the signal in the immediately previous frame is the first mode or the determination of operation 420 indicates that the history value in the zeroth mode is 0, the coding mode of the signal for the current frame, e.g., as selected in operation 210, would not be changed. Here, a case when the history value in the zeroth mode is 0, for example, may refer to a case when the history value in the zeroth mode corresponds to a pre-set minimum value or a case when the signal in the immediately previous frame, for example, corresponds to a silence period and thus is reset.

Otherwise, if the determination of operation 400 indicates that the coding mode selected in operation 210 is the zeroth mode, a determination is then made as to whether the coding mode of the signal in the immediately previous frame, for example, is the zeroth mode or the first mode (operation 430).

If the determination of operation 430 indicates that the coding mode of the signal in the immediately previous frame, for example, is the first mode, a determination is then made as to whether a history value in the first mode is greater than an example 0 (operation 440).

If the determination of operation 440 indicates that the history value in the first mode is greater than the example 0, the coding mode of the signal for the current frame, e.g., as selected in operation 210, may be changed from the zeroth mode to the first mode (operation 230).

Otherwise, if the determination of operation 430 indicates that the coding mode of the signal in the immediately previous frame, for example, is the zeroth mode or the determination of operation 440 indicates that the history value in the first mode is the example 0, the coding mode of the signal for the current frame, e.g., as selected operation 210, would not be changed. Here, a case when the history value in the first mode is the example 0 may refer to a case when the history value in the first mode corresponds to a pre-set minimum value or a case when the signal in the immediately previous frame, for example, corresponds to a silence period and thus is reset.

Figure 5:
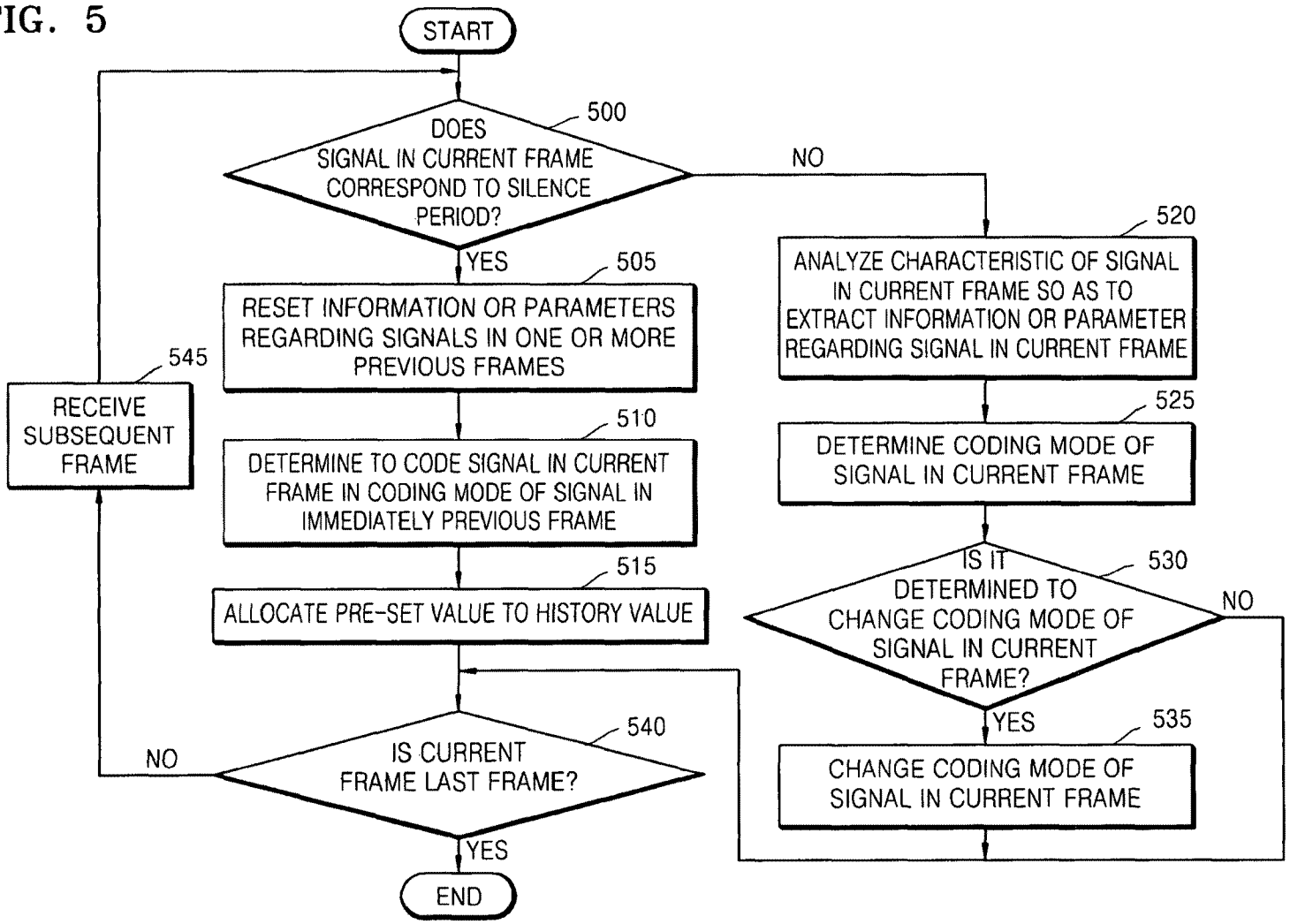
FIG. 5 illustrates a coding mode determination method, according to one or more embodiments.

FIG. 5 illustrates a coding mode determination method, according to one or more embodiments.

Referring to FIG. 5, initially, a determination is made as to whether a signal in a current frame corresponds to a silence period (operation 500). The determination of operation 500 may be performed based on the energy or the characteristic of the signal in the current frame. For example, if the energy is less than a threshold value, it may be determined that the signal in the current frame corresponds to the silence period, again noting that alternative techniques for silence period detection are available.

If the determination of operation 500 indicates that the signal in the current frame corresponds to the silence period, information and/or parameters regarding signals in one or more previous frames, which may be stored for use in setting a coding mode of the signal for the current frame, from among a plurality of signal coding modes, may be reset (operation 505).

The information or the parameters regarding the signals in the previous frames, which are reset in operation 505, may be information or parameters regarding long-term features. In operation 505, from among the long-term features, a mean value regarding short-term features of signals in a pre-set number of previous frames, and/or a history value of speech or music presence possibilities of a signal in a predetermined frame may be reset, for example.

Here, a long-term feature refers to information obtained by analyzing transitions of short-term features of signals in one or more previous frames. A short-term feature refers to a peculiar characteristic of each frame and may include information or parameters such as an LP-LTP gain, a spectrum tilt, a zero crossing rate, and a spectrum auto-correlation. In one or more embodiments, such peculiar characteristics may be selectable in implementation of the present invention.

As only an example, the long-term features include a mean value regarding short-term features of signals in a pre-set number of previous frames, a speech or music presence possibility of a signal in a predetermined frame, and a history value of speech or music presence possibilities. From among the long-term features, an SPP may be calculated, e.g., by using the above Equation 1. In addition, the history value of the speech or music presence possibilities refers to a value obtained by applying weights to speech or music presence possibilities of signals in a predetermined number of frames and accumulating the speech or music presence possibilities. An example of a method of calculating a history value of SPPs has been representatively described above with reference to FIG. 3.

Figure 6:
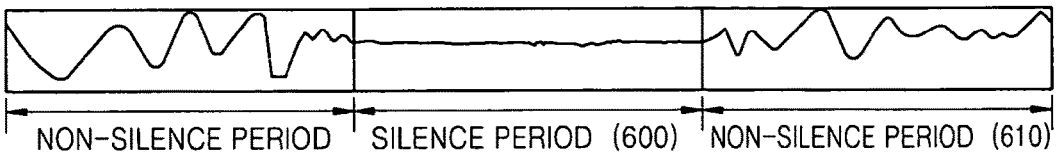
FIG. 6 illustrates a silence period and a non-silence period, according to one or more embodiments.

FIG. 6 illustrates a silence period and a non-silence period, according to one or more embodiments.

Referring to FIG. 6, when a first period 600, i.e., the silence period, is followed by a second period 610, i.e., the non-silence period, in order to reduce errors caused at a moment when a frame corresponding to the silence period is changed into a frame corresponding to the non-silence period, a weight of an SPP to be reflected to a history value may be gradually increased from an initial frame corresponding to a non-silence period changed from a silence period, to a predetermined frame. For example, the lowest weight may be applied to an initial frame corresponding to a non-silence period changed from a silence period, which may have the lowest accuracy. Then, a weight to be applied may be gradually increased from a subsequent frame of the initial frame and the highest weight may be applied from a predetermined frame so as to fully reflect an SPP to a history value.

Referring back to FIG. 5, after performing operation 505, a determination is made as to whether to code the signal in the current frame in a coding mode of a signal in an immediately previous frame (operation 510).

After performing operation 510, a pre-set value may be allocated to the history value of the speech or music presence possibilities of the signal in the current frame (operation 515). For example, in the example of FIG. 3, when a coding mode of a signal in an immediately previous frame is a first mode, a value x may be allocated to a history value in the first mode and a value y may be allocated to a history value in a zeroth mode. When the coding mode of the signal in the immediately previous frame is the zeroth mode, a value v may be allocated to the history value in the first mode and a value w may be allocated to the history value in the zeroth mode. Here, the values x, y, v, and w may be pre-set values.

Otherwise, if the determination in operation 500 indicates that the signal in the current frame does not correspond to the silence period, the characteristic of the signal in the current frame may be analyzed so as to extract information or a parameter regarding the signal in the current frame (operation 520). Examples of the information or the parameter regarding the signal in the current frame, which is extracted in operation 520, include short-term and long-term features, for example.

The coding mode of the signal in the current frame may be selected from among a plurality of signal coding modes based on the information or the parameter regarding the signal in the current frame, which is extracted in operation 520 (operation 525). Here, examples of the signal coding modes include a time-domain coding mode such as a CELP method and a frequency-domain coding mode such as a TCX method or an AAC method. The examples of the signal coding modes may also include a speech coding mode and a music coding mode. Here, additional and/or alternative coding modes may be available, and embodiments are not limited to such indicated coding modes.

After performing operation 525, a determination is made as to whether to change the coding mode, selected in operation 525, by using a coding mode of a signal in one or more previous frames, and/or speech or music presence possibilities of signals in a predetermined number of previous frames and the signal in the current frame (operation 530). The speech or music presence possibilities of the signals in the previous frames and the signal in the current frame may be represented by the above-described history value of the speech or music presence possibilities. An example of operation 530 has been described in detail above with reference to FIG. 3.

If the determination of operation 530 indicates to change the coding mode selected in operation 525, the coding mode selected in operation 525 is changed (operation 535).

After performing operation 515 or operation 535, a determination is made as to whether the current frame is a last frame (operation 540).

If the determination of operation 540 indicates that the current frame is not the last frame, a subsequent frame may be received (operation 545) and operations 500 through 540 may be repeatedly performed on the subsequent frame(s).

Figure 7:
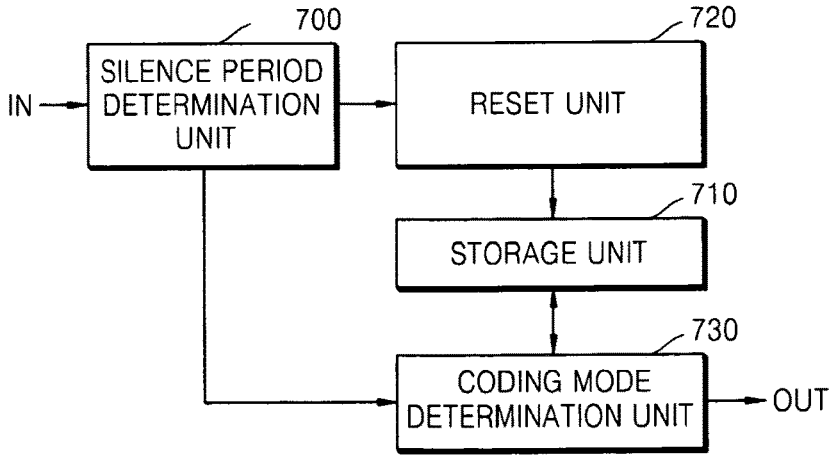
FIG. 7 illustrates a coding mode determination apparatus, according to one or more embodiments.

FIG. 7 illustrates a coding mode determination apparatus, according to one or more embodiments. Herein, the term apparatus should be considered synonymous with elements of a physical system, not limited to a single enclosure or all described elements embodied in single respective enclosures in all embodiments, but rather, depending on embodiment, is open to being embodied together or separately in differing enclosures and/or locations through differing elements. As only another example, a respective apparatus/system or method could also be controlled through one or more processing elements/devices or implemented by a distributed network, noting that additional and alternative embodiments are equally available.

Referring to FIG. 7, the coding mode determination apparatus may include a silence period determination unit 700, a storage unit 710, a reset unit 720, and a coding mode determination unit 730, for example. Any of the silence period determination unit 700, the storage unit 710, the reset unit 720, and the coding mode determination unit 730 may be implemented as at least one processor or processing device.

The silence period determination unit 700 may determine whether a signal in a current frame received through an input terminal IN corresponds to a silence period. The determination by the silence period determination unit 700 may be performed based on the energy or the characteristic of the signal in the current frame. For example, if the energy is less than a threshold value, it may be determined that the signal in the current frame corresponds to the silence period, again noting that alternate silence detection techniques are available.

The storage unit 710 stores information or parameters regarding signals in one or more previous frames, which are used to select a coding mode for the signal in the current frame from among a plurality of signal coding modes. Also, the storage unit 710 may store plural coding modes for signals of a predetermined number of previous frames.

If the silence period determination unit 700 determines that the signal in the current frame corresponds to the silence period, the reset unit 720 may reset the information or the parameters regarding the signals in the previous frames, which are stored in the storage unit 710.

The information or the parameters regarding the signals in the previous frames, which may be reset by the reset unit 720, may be information or parameters regarding long-term features, for example. From among the long-term features, the reset unit 720 may reset a mean value regarding short-term features of signals in a pre-set number of previous frames, or a history value of speech or music presence possibilities of a signal in a predetermined frame.

Here, a long-term feature refers to information obtained by analyzing transitions of short-term features of signals in one or more previous frames. For example, long-term features include a mean value regarding short-term features of signals in a pre-set number of previous frames, a speech or music presence possibility of a signal in a predetermined frame, and a history value of speech or music presence possibilities. A short-term feature refers to a peculiar characteristic of each frame and may include any of information or parameters such as an LP-LTP gain, a spectrum tilt, a zero crossing rate, and a spectrum auto-correlation, for example.

If the silence period determination unit 700 determines that the signal in the current frame corresponds to the silence period, the coding mode determination unit 730 may determine to code the signal in the current frame in a coding mode of a signal in an immediately previous frame, and the coding mode determined by the coding mode determination unit 730 may be output through an output terminal OUT.

On the other hand, if the silence period determination unit 700 determines that the signal in the current frame does not correspond to the silence period, the coding mode determination unit 730 may analyze the characteristic of the signal in the current frame so as to extract information or a parameter regarding the signal in the current frame, and select the coding mode for the signal in the current frame from among a plurality of signal coding modes based on the information or the parameters regarding the signals in the previous frames and the information or the parameter regarding the signal in the current frame. The coding mode determined by the coding mode determination unit 730 may be output through the output terminal OUT. Examples of the information or the parameter regarding the signal in the current frame, which is extracted by the coding mode determination unit 730, may include the above-described short-term and long-term features, for example. The coding mode determination unit 730 may store the information or the parameter regarding the signal in the current frame in the storage unit 710.

Here, examples of the signal coding modes include a time-domain coding mode such as a CELP method and a frequency-domain coding mode such as a TCX method or an AAC method. The examples of the signal coding modes may also include a speech coding mode and a music coding mode. Here, additional and/or alternative coding modes may be available, and embodiments are not limited to such indicated coding modes.

Figure 8:
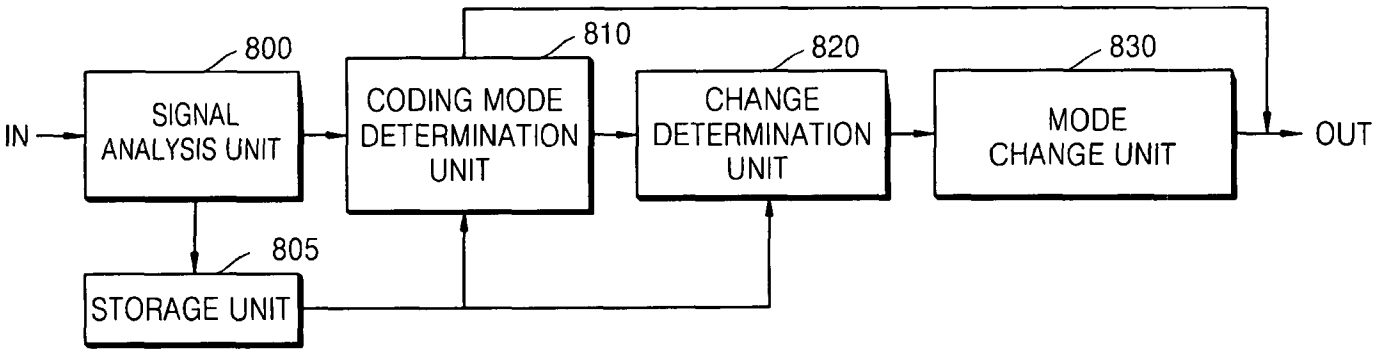
FIG. 8 illustrates a coding mode determination apparatus, according to one or more embodiments.

FIG. 8 illustrates a coding mode determination apparatus, according to one or more embodiments.

Referring to FIG. 8, the coding mode determination apparatus may include a signal analysis unit 800, a storage unit 805, a coding mode determination unit 810, a change determination unit 820, and a mode change unit 830, for example. Any of the signal analysis unit 800, the storage unit 805, the coding mode determination unit 810, the change determination unit 820, and the mode change unit 830 may be implemented as at least one processor or processing device.

The signal analysis unit 800 may analyze the characteristic of a signal in a current frame, e.g., as received through an input terminal IN, so as to extract information or a parameter regarding the signal in the current frame. Examples of the information or the parameter extracted by the signal analysis unit 800 may include short-term and long-term features, for example. A short-term feature refers to a peculiar characteristic of each frame and may include information or parameters such as an LP-LTP gain, a spectrum tilt, a zero crossing rate, and a spectrum auto-correlation, for example. A long-term feature refers to information obtained by analyzing transitions of short-term features of signals in one or more previous frames. For example, the long-term feature may include a mean value regarding short-term features of signals in a pre-set number of previous frames, a speech or music presence possibility of a signal in a predetermined frame, and a history value of speech or music presence possibilities, for example.

From among the long-term features, an SPP may be calculated, e.g., by using the above Equation 1. It is again noted that embodiments of the present invention are not limited to the SPP.

In addition, the history value of the speech or music presence possibilities refers to a value obtained by applying weights to speech or music presence possibilities of signals in a predetermined number of frames and accumulating the speech or music presence possibilities. An example method of calculating a history value of SPPs has been representatively described above with reference to FIG. 3.

The storage unit 805 may store information or parameters regarding signals in one or more previous frames, which can be used to select a coding mode of the signal in the current frame from among a plurality of signal coding modes. In addition, the storage unit 805 may store coding modes of signals in a predetermined number of previous frames.

The coding mode determination unit 810 may select the coding mode of the signal in the current frame from among a plurality of signal coding modes by using the information or the parameter regarding the signal in the current frame, which is extracted by the signal analysis unit 800. Here, examples of the signal coding modes include a time-domain coding mode such as a CELP method and a frequency-domain coding mode such as a TCX method or an AAC method. The examples of the signal coding modes may also include a speech coding mode and a music coding mode. Here, additional and/or alternative coding modes may be available, and embodiments are not limited to such indicated coding modes.

The change determination unit 820 may determine whether to change the coding mode selected by the coding mode determination unit 810, by using a coding mode of a signal in a previous frame, and/or speech or music presence possibilities of signals in a predetermined number of previous frames and the signal in the current frame. The speech or music presence possibilities of the signals in the previous frames and the signal in the current frame may be represented by the above-described history value of the speech or music presence possibilities. An example operation of the change determination unit 820 has been described in detail above with reference to FIG. 3.

If the change determination unit 820 determines to change the coding mode selected by the coding mode determination unit 810, the mode change unit 830 changes the coding mode selected by the coding mode determination unit 810. The coding mode may be changed by the mode change unit 830 and further output through an output terminal OUT.

On the other hand, if the change determination unit 820 determines not to change the coding mode selected by the coding mode determination unit 810, the coding mode selected by the coding mode determination unit 810 may be output through the output terminal OUT.

Figure 9:
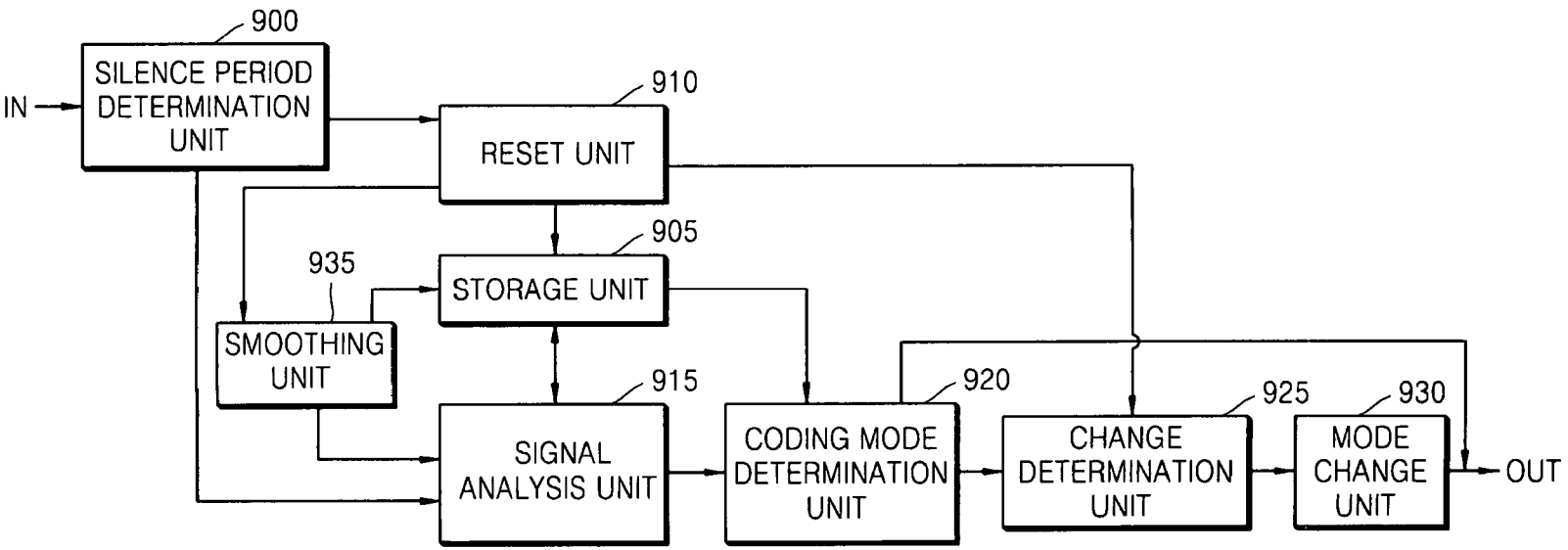
FIG. 9 illustrates a coding mode determination apparatus, according to one or more embodiments.

FIG. 9 illustrates a coding mode determination apparatus, according to one or more embodiments.

Referring to FIG. 9, the coding mode determination apparatus may include a silence period determination unit 900, a storage unit 905, a reset unit 910, a signal analysis unit 915, a coding mode determination unit 920, a change determination unit 925, a mode change unit 930, and a smoothing unit 935, for example. Any of the silence period determination unit 900, the storage unit 905, the reset unit 910, the signal analysis unit 915, the coding mode determination unit 920, the change determination unit 925, the mode change unit 930, and the smoothing unit 935 may be implemented as at least one processor or processing device.

The silence period determination unit 900 determines whether a signal in a current frame, e.g., as received through an input terminal IN, corresponds to a silence period. The determination by the silence period determination unit 900 may be performed based on the energy or the characteristic of the signal in the current frame. For example, if the energy is less than a threshold value, it may be determined that the signal in the current frame corresponds to the silence period, again noting that alternative silence detection techniques are equally available.

The storage unit 905 may store information or parameters regarding signals for one or more previous frames, which can be used to select a coding mode of the signal for the current frame, from among a plurality of signal coding modes. In addition, the storage unit 905 may store coding modes of signals in a predetermined number of previous frames.

If the silence period determination unit 900 determines that the signal in the current frame corresponds to the silence period, the reset unit 910 may reset the information or the parameters regarding the signals in the previous frames, e.g., which may be stored in the storage unit 905.

The information or the parameters regarding the signals in the previous frames, which may be reset by the reset unit 910, may be information or parameters regarding long-term features, for example. From among the long-term features, the reset unit 910 may reset a mean value regarding short-term features of signals in a pre-set number of previous frames, or a history value of speech or music presence possibilities of a signal in a predetermined frame, for example.

Here, a long-term feature refers to information obtained by analyzing transitions of short-term features of signals in one or more previous frames. A short-term feature refers to a peculiar characteristic of each frame and may include information or parameters such as an LP-LTP gain, a spectrum tilt, a zero crossing rate, and a spectrum auto-correlation.

For example, the long-term features include a mean value regarding short-term features of signals in a pre-set number of previous frames, a speech or music presence possibility of a signal in a predetermined frame, and a history value of speech or music presence possibilities. From among the long-term features, an SPP may be calculated, e.g., by using the above Equation 1. In addition, the history value of the speech or music presence possibilities refers to a value obtained by applying weights to speech or music presence possibilities of signals in a predetermined number of frames and accumulating the speech or music presence possibilities. An example method of calculating a history value of SPPs has been representatively described above with reference to FIG. 3.

If the silence period determination unit 900 determines that the signal in the current frame does not correspond to the silence period, the signal analysis unit 915 analyzes the characteristic of the signal in the current frame so as to extract information or a parameter regarding the signal in the current frame. Examples of the information or the parameter extracted by the signal analysis unit 915 include short-term and long-term features, for example.

However, if the silence period determination unit 900 determines that the signal in the current frame corresponds to the silence period, the signal analysis unit 915 allocates a pre-set value to the history value of the speech or music presence possibilities of the signal in the current frame. For example, as noted above regarding FIG. 3, if a coding mode of a signal in an immediately previous frame is a first mode, a value x may be allocated to a history value in the first mode and a value y may be allocated to a history value in a zeroth mode. If the coding mode of the signal in the immediately previous frame is the zeroth mode, a value v may be allocated to the history value in the first mode and a value w may be allocated to the history value in the zeroth mode. Here, the values x, y, v, and w may be pre-set values.

If the silence period determination unit 900 determines that the signal in the current frame does not correspond to the silence period, the coding mode of the signal for the current frame may be selected from among a plurality of signal coding modes based on the information or the parameter regarding the signal in the current frame, which is extracted by the signal analysis unit 915. Here, examples of the signal coding modes include a time-domain coding mode such as a CELP method and a frequency-domain coding mode such as a TCX method or an AAC method. The examples of the signal coding modes may also include a speech coding mode and a music coding mode. Here, additional and/or alternative coding modes may be available, and embodiments are not limited to such indicated coding modes.

However, if the silence period determination unit 900 determines that the signal in the current frame corresponds to the silence period, the coding mode determination unit 920 may determine to code the signal in the current frame in a coding mode of a signal in an immediately previous frame.

The change determination unit 925 may determine whether to change the coding mode selected by the coding mode determination unit 920, by using a coding mode of a signal in a previous frame, and/or speech or music presence possibilities of signals in a predetermined number of previous frames and the signal in the current frame. The speech or music presence possibilities of the signals in the previous frames and the signal in the current frame may be represented by the above-described history value of the speech or music presence possibilities. An example operation of the change determination unit 925 has been described in detail above with reference to FIG. 3.

If the change determination unit 925 determines to change the coding mode selected by the coding mode determination unit 920, the mode change unit 930 changes the coding mode selected by the coding mode determination unit 920, and the coding mode changed by the mode change unit 930 is output through an output terminal OUT.

However, otherwise, if the change determination unit 925 determines not to change the coding mode determined by the coding mode determination unit 920, the coding mode selected by the coding mode determination unit 920 may be output through the output terminal OUT.

If, as illustrated in FIG. 6, the first period 600, i.e., a silence period, is followed by the second period 610, i.e., a non-silence period, in order to reduce errors caused at a moment when a frame corresponding to the silence period is changed into a frame corresponding to the non-silence period, the smoothing unit 935 may gradually increase a weight of an SPP to be reflected to a history value from an initial frame corresponding to a non-silence period changed from a silence period, to a predetermined frame. For example, the lowest weight may be applied to an initial frame corresponding to a non-silence period changed from a silence period, which may have the lowest accuracy. Then, a weight to be applied may be gradually increased from a subsequent frame of the initial frame and the highest weight may be applied from a predetermined frame so as to fully reflect an SPP to a history value.

In addition to the above described embodiments, one or more embodiments may also be implemented through computer readable code/instructions in/on a medium, e.g., a computer readable medium, to control at least one processing device to implement any above described embodiment. The medium can correspond to any defined, measurable, and tangible structure permitting the storing and/or transmission of the computer readable code.

The media may also include, e.g., in combination with the computer readable code, data files, data structures, and the like. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of computer readable code include both machine code, such as produced by a compiler, and files containing higher level code that may be executed by the computer using an interpreter, for example. The media may also be a distributed network, so that the computer readable code is stored and executed in a distributed fashion. Still further, as only an example, the processing element could include a processor or a computer processor, and processing elements may be distributed and/or included in a single device.

While aspects of the present invention has been particularly shown and described with reference to differing embodiments thereof, it should be understood that these exemplary embodiments should be considered in a descriptive sense only and not for purposes of limitation. Descriptions of features or aspects within each embodiment should typically be considered as available for other similar features or aspects in the remaining embodiments.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A coding mode determination method for an audio signal, the method comprising:

determining a coding mode of a current frame based on a first plurality of signal characteristics of the current frame, from among a plurality of coding modes including a music coding mode and a speech coding mode;

obtaining a second plurality of signal characteristics from a first plurality of frames;

determining, performed by at least one processing device, whether to change the determined coding mode of the current frame, based on the second plurality of signal characteristics and a parameter to prevent frequent switching among the plurality of coding modes; and when the determined coding mode of the current frame is determined to be changed, changing the determined coding mode of the current frame to another mode among the plurality of coding modes, wherein the second plurality of signal characteristics include a signal characteristic determined based on the current frame and a predetermined number of previous frames.

2. The method of claim 1, wherein the parameter to prevent frequent switching among the plurality of coding modes is associated with a history of coding modes obtained from a second plurality of frames.

3. An encoding method for an audio signal, the method comprising:

determining a coding mode of a current frame based on a first plurality of signal characteristics of the current frame, from among a plurality of coding modes including a music coding mode and a speech coding mode;

obtaining a second plurality of signal characteristics from a plurality of frames;

determining, performed by at least one processing device, whether to change the determined coding mode of the current frame, based on the second plurality of signal characteristics and a parameter to prevent frequent switching among the plurality of coding modes;

when the determined coding mode of the current frame is determined to be changed, changing the determined coding mode of the current frame to another mode among the plurality of coding modes;

encoding the current frame, according to either the determined coding mode when the determined coding mode of the current frame is determined not to be changed or the changed coding mode when the determined coding mode of the current frame is determined to be changed; and transmitting a bitstream including a result of the encoding, for reproduction of music or speech, wherein the second plurality of signal characteristics include a signal characteristic determined based on the current frame and a predetermined number of previous frames.

4. The method of claim 3, wherein the parameter to prevent frequent switching among the plurality of coding modes is associated with a history of coding modes obtained from a second plurality of frames.

* * * * *